US008917183B2

(12) United States Patent
Wong

(10) Patent No.: US 8,917,183 B2
(45) Date of Patent: Dec. 23, 2014

(54) METHANE AND WATER VAPOR GAS SENSORS INTEGRATED INTO A PERSONAL MINER'S ALARM

(71) Applicant: Airware, Inc., Goleta, CA (US)

(72) Inventor: Jacob Y Wong, Goleta, CA (US)

(73) Assignee: Airware, Inc, Goleta, CA (US)

( * ) Notice: Subject to any disclaimer, the term of this patent is extended or adjusted under 35 U.S.C. 154(b) by 49 days.

(21) Appl. No.: 13/797,738

(22) Filed: Mar. 12, 2013

(65) Prior Publication Data

US 2014/0266748 A1 Sep. 18, 2014

(51) Int. Cl.
*G08B 21/00* (2006.01)
*G08B 21/12* (2006.01)

(52) U.S. Cl.
CPC ..... *G08B 21/12* (2013.01)
USPC ..... 340/632; 250/336.1

(58) Field of Classification Search
CPC ..... G01N 21/3504
USPC ..... 340/628, 629, 630, 632; 250/336.1, 250/339.15, 339.13
See application file for complete search history.

(56) References Cited

U.S. PATENT DOCUMENTS 7,186,979 B1 * 3/2007 Wong ..... 250/336.1
8,203,458 B2 * 6/2012 Kaneblei et al. ..... 340/632

* cited by examiner

*Primary Examiner* — Jeffery Hofsass
(74) *Attorney, Agent, or Firm* — Roy L. Anderson; Wagner Anderson & Bright PC

(57) ABSTRACT

A miner's personal gas alarm can be mounted in a helmet powered by a rechargeable battery for a light or be self-contained. A visual indicator will generate an alarm when the concentration of gas detected by the gas sensor triggers an alarm condition. An audio alarm can also be generated by the alarm condition. The gas sensor is a non-dispersive infrared ("NDIR") gas sensor. When the gas sensor detects methane, the alarm condition is triggered by either an abnormally high rate of increase of methane concentration level or by an elevated concentration of methane that is above approximately 500 ppm and substantially below a lower explosion limit of methane (e.g., approximately 10,000 ppm), and the gas sensor is recalibrated whenever the sample concentration of methane falls below an ambient threshold level of methane.

11 Claims, 2 Drawing Sheets

METHANE AND WATER VAPOR GAS SENSORS INTEGRATED INTO A PERSONAL MINER'S ALARM

FIELD OF THE INVENTION

The present invention is in the field of gas sensors used as personal safety devices by miner to detect and warn of dangerous gas conditions in a mine.

BACKGROUND OF THE INVENTION

The NDIR technique utilizing characteristic absorption bands of gases in the infrared has been widely used for decades in the gas analyzer industry for detection of these gases. Such gas analyzers utilize the principle that various gases exhibit substantial absorption at specific wavelengths in the infrared radiation spectrum. The term "non-dispersive" as used herein refers to the apparatus used, typically a narrow-band optical or infrared transmission filter instead of a dispersive element such as a prism or diffraction grating, for isolating for the purpose of measurement the radiation in a particular wavelength band that coincides with a strong absorption band of a gas to be measured. The NDIR technique has long been considered as one of the best methods for gas measurement. In addition to being highly specific, NDIR gas sensors are also very sensitive, relatively stable and easy to operate and maintain. In contrast to NDIR gas sensors, the majority of other types of gas sensors today are in principle interactive. Interactive gas sensors are less reliable, short-lived and generally nonspecific, and in some cases can be poisoned or saturated into a nonfunctional or irrecoverable state.

Despite the fact that interactive gas sensors are mostly unreliable and that the NDIR gas measurement technique is one of the best there is, NDIR gas sensors still have not enjoyed widespread high volume usage to date. There are three main reasons for this.

First, there are several applications in existence today that would require a very large number of gas sensors typically running into millions of units. One of the most outstanding examples is a personal methane ($CH_4$) sensor worn or carried by a miner working underground in mines for detecting concentrations of gas approaching explosion limit levels when a so-called "methane pocket" is encountered and opened up during coal excavations. Since methane is odorless, there is no way for miners working underground to be warned of this deadly situation when a "methane pocket" is opened up without a personal methane sensor. If miners continue to excavate coal deposits and thus generate sparks as usual without heeding this dangerous working environment, an explosion can eventually be triggered underground when the lowest explosion limit (LEL) of methane is quickly reached.

A parallel situation might also exist when miners encounter an underground "water reservoir" while excavating (coal or otherwise). In such a situation, unless miners can by some means heed this potential flooding danger, thereby stopping work and evacuating the work site immediately, flooding could take place if miners continue to excavate and unknowingly open up a "water reservoir." When flooding actually takes place, not only the workers working in the immediate area can face drowning, workers in neighboring sites can also be drowned. Furthermore, flooding of part or all of underground working tunnels and the subsequent necessary cleanup operations can impose a very large financial burden upon the affected mine. It is highly unlikely that the opening up of an underground "water reservoir" is very sudden and leads to immediate flooding of the work site without any early warning. Rather, it is far more likely that cracks leading to a "water reservoir" are first exposed during the excavating operation. In addition to small amounts of water seeping out which could be unnoticed, a large amount of water vapor from the underground reservoir will rush out into the atmosphere of the immediate work site. The amount of water vapor in the air at the immediate work site would rise very suddenly without any apparent reasons. If miners are equipped with a sensitive personal Dew Point (water vapor) sensor, this sudden rise in water vapor pressure in the air where they work can be detected. If the rate of water vapor pressure increase in the air is detected to exceed a certain high and unexplainable level, miners can then be immediately warned of the danger of encountering an underground "water reservoir" and they should stop work promptly, evacuating the work site and notifying the authorities above ground for an immediate investigation.

But gas sensors to be deployed in such applications, namely methane and dew point (water vapor) sensors, must be extraordinarily reliable. However, just about all gas sensors ever designed and manufactured to date, irrespective of what technology is being employed, invariably have significant output drifts over time. For this reason, sensor maintenance cost concerns render today's NDIR gas sensors unqualified to be used in such an application since they all require re-calibration maintenance service every six months to a year without exception in order for them to stay accurate over time as effective alarms.

The second reason why today's NDIR gas sensors do not enjoy widespread high volume usage has to do with their size. At present they are typically several inches in length, width and height dimensions, and such dimension are generally considered to be too big. Even if such sensors overcome their output drift reliability problem, which so far they have not, their physical dimensions remain a significant impediment to their utilization and must be drastically reduced to gain usefulness as underground warning devices in mines. Although the size of NDIR gas sensors has indeed been greatly reduced to just a couple of inches in all three dimensions in the last few years, they still are too big, and they have to be further reduced, preferably to just thumb-sized scales, in order to remove their size hindrance in the currently discussed high volume usage application.

The third and final reason why NDIR gas sensors do not enjoy widespread high volume usage is their unit production cost which has been too high for the application discussed above. About four decades ago, an NDIR gas sensor (e.g. medical $CO_2$) was sold for more than $10,000.00 each. By the early 1990's, the unit selling price for an NDIR gas sensor (e.g. $CO_2$) dropped to less than $500.00. Today the unit selling price of an NDIR gas sensor (e.g. $CO_2$) goes for about $200.00, reflecting the fact that the unit production cost for such a sensor has dropped to just around $50.00 or less. But even this relatively low and reasonable unit production cost today is still too high for the above discussed application. For this application the unit production cost for an NDIR methane or dew point (water vapor) gas sensor has to be under US$10.00.

Since the three main reasons why NDIR gas sensors do not enjoy widespread high volume usages today, particularly for the application of protecting miners working underground from deadly methane explosions and/or flooding, are still not under control for elimination or remedy as conjectured in the discussion above, an object of the present invention is to eliminate these three reasons altogether. The current invention will render the outputs of NDIR gas sensors stable over time, will reduce these sensors to a very small size and finally will reduce the unit production cost of these NDIR gas sensors to just a few US dollars. The current invention is particularly well-suited for use in the application of producing methane and dew point sensors for use underground in mines for eliminating the danger of future methane explosions and/or flooding.

SUMMARY OF THE INVENTION

The present invention is generally directed to personal miner safety devices that use a gas sensor to generate an alarm condition when a dangerous gaseous condition exists in a mine.

In a first embodiment of the present invention, a miner's helmet which has a light mounted at a front side of the helmet, a power source mounted to the helmet that is electrically connected to the light, a gas sensor mounted to the helmet that is electrically connected to the power source, a visual indicator mounted to a rear side of the helmet, and electronics for changing the visual indicator in response to output from the gas sensor. The gas sensor measures a concentration of a gas of interest and causes the visual indicator to display an alarm when the concentration of gas detected by the gas sensor triggers an alarm condition of the electronics.

In one, separate group of aspects of this embodiment, the visual indicator provides a first visual indication when the gas sensor is on and a second visual indication when the alarm condition is triggered and an audible alarm device is mounted to the miner's helmet that sounds an audible alarm when the alarm condition is triggered.

In alternative embodiments of the present invention, a gas sensor, with its own power source, is contained in a housing with an alarm indicator.

In another, separate group of aspects of the present invention, the gas sensor is a non-dispersive infrared ("NDIR") gas sensor. A suitable NDIR gas sensor can be a single beam NDIR gas sensor in which infrared radiation is emitted from a single infrared source into a sample chamber that is alternatively pulsed at a high temperature and at a low temperature, the infrared radiation is detected after it passes through a narrow band pass filter with a spectral characteristic that substantially overlaps a strong absorption band for the gas to be detected, and the concentration of the gas is determined by use of an absorption bias between a signal output of the detector at the high temperature and a reference output of the detector at the low temperature, the convoluted output of the single infrared source and the narrow band pass filter being substantially coincident with the strong absorption band.

In yet another, separate group of aspects of the present invention, the gas of interest is methane and the alarm condition is triggered by either an abnormally high rate of increase of methane concentration level (e.g., a monotonic rate of increase of approximately 1,000 ppm/min. for a predetermined period of time) or by an elevated concentration of methane that is above approximately 500 ppm and substantially below a lower explosion limit of methane (e.g., approximately 10,000 ppm), and the gas sensor is recalibrated whenever the sample concentration of methane falls below an ambient threshold level of methane.

In a further, separate group of aspects of the present invention, the gas of interest is water vapor and the alarm condition is triggered by an abnormally high rate of increase of water vapor over a short period of time (e.g., a rate of 30 mmHg/min monotonic increase of water vapor pressure over a period of 10 minutes).

In a final, separate group of aspects of the present invention, the gas sensor is mounted within a metallic housing (which is mounted to an outside surface of the rear side of the miner's helmet when the personal alarm device is used with a helmet), the housing has a plurality of housing apertures, each of which is covered with a filter, and the sample chamber has a plurality of sample chamber apertures, each of which is covered with a fine filter. Additionally, the electronics will trigger a failsafe alarm condition when the signal output of the detector falls below an obscuration level and the electronics are operated below 3.0 VDC.

It is therefore a primary object of the present invention to advance an improved personal miner's alarm having a gas detection sensor that provides an alarm when it detects a dangerous gas condition.

This and further objects and advantages will be apparent to those skilled in the art in connection with the drawings and the detailed description of the invention set forth below.

DETAILED DESCRIPTION OF THE INVENTION

Figure 1:
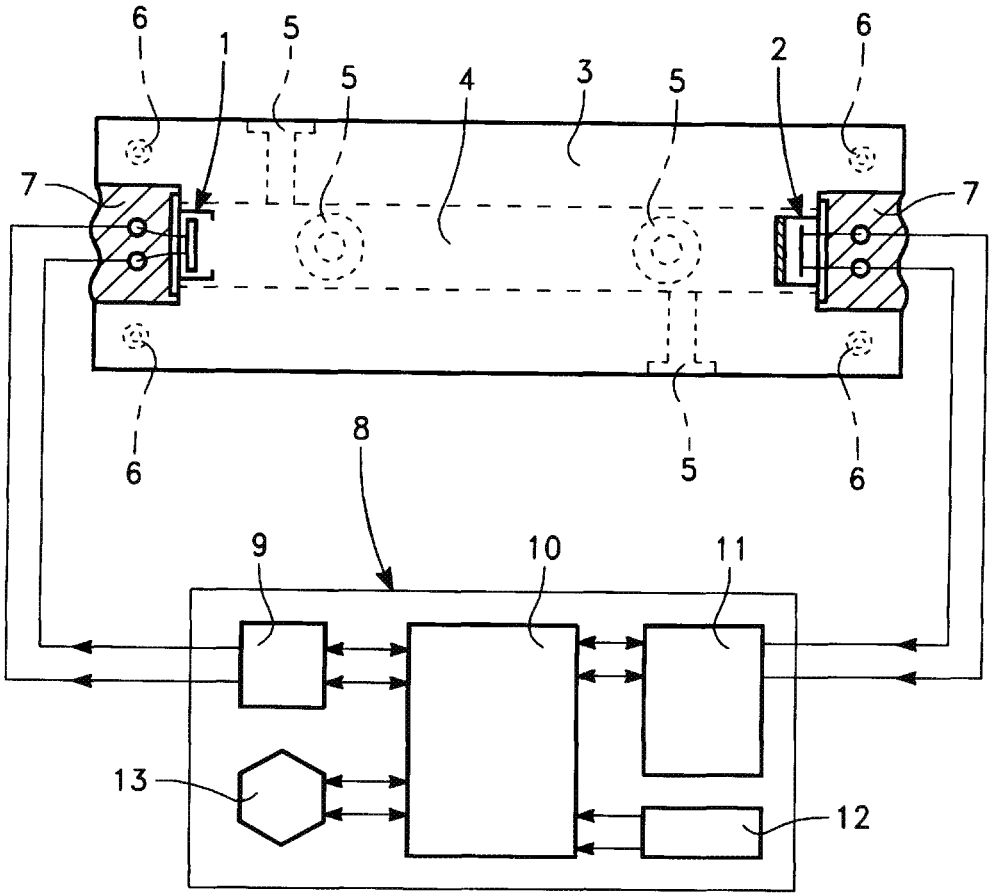
FIG. 1 is a schematic drawing of the mechanical and electronic layouts of a Single Beam NDIR gas sensor for use in the present invention.

The main objective of the current invention is to open the door for NDIR gas sensors to enjoy widespread high volume usage by eliminating or remedying problems regarding their output stability over time, their relatively bulky size and unacceptably high unit production cost for many applications. In addition, the current invention specifically addresses its unique usefulness as warning gas sensors for miners working underground to heed the danger of methane explosions and/or flooding which still are occurring far too often in coal mines today.

The approach of the current invention is to first come up with a novel NOIR gas sensor detection methodology that can circumvent all three of the deficient features of many NDIR gas sensors currently available today. With this novel gas detection methodology firmly established, the current invention then proceeds to address the design of the actual sensor itself bearing in mind that it must meet not only stability, size and unit production cost requirements, but also be adapted for use in coal mines as explosion and/or flood warning devices for miners working underground.

In order to improve the performance and cost of the conventional double beam NDIR gas sensor, one has to seek favorable opportunities in the gas sensor assembly end of this class of devices. If one can reduce the number of detectors from two to one, which in effect reduces the double beam methodology into a single beam one, while at the same time capable of rendering this new and simplified technique adequately performing as an accurate, reliable and stable NDIR gas sensor, then the goal of achieving one of the three main objectives referred to above, namely the design for an ultra low cost NDIR gas sensor, will have been accomplished. The use of only one infrared source and one detector to configure an NDIR gas sensor is commonly known as the Single Beam methodology and was in fact the first one deployed almost six decades ago. Although a single beam implementation for an NDIR gas sensor is absolutely the simplest methodology possible, over the years people soon found out that it has numerous drawbacks, including severe sensor output drifts, output changes due to contamination of optical components, and external temperature dependences.

The first approach of the current invention is to come up with a gas detection methodology that can function equivalently as a conventional double beam technique but with only a single infrared source and a single detector. Since the roles played by the detectors in the double beam methodology are rather rigid, reducing the number of them from two to one seems like an impossible undertaking. It seems like the only approach would be to try to do something with the infrared source which is more flexible. As disclosed earlier in U.S. Pat. No. 5,026,992 (1991) by the present author, one can change the spectral characteristic output of a blackbody source according to Planck's radiation curves by driving it at different power levels in order to reach different operating blackbody temperatures. This can be readily achieved since one usually pulses the infrared source for the double beam gas sensing technique. But by so doing it is possible to create two beams at different times with different spectral output characteristics for the source.

The present invention takes advantage of the fact that one can create both a Reference channel and a Signal channel by using the technique of a differential temperature source as described briefly above with just one infrared source and one detector or the so-called Single Beam methodology technique. This is accomplished by the use of a low amplitude source drive cycle as the Reference channel when the source temperature is rendered very low followed by a high amplitude source drive cycle as the Signal channel when the source temperature is rendered relatively high. Following the teaching for the design of an output stable double beam NDIR gas sensor as disclosed in U.S. Pat. No. 8,143,581 by Wong (2012) where an absorption bias was created between the Reference channel and the Signal channel in order to afford sensor calibration for the gas of interest, if a similar absorption bias can be created for the current Single Beam approach between the Reference channel (low amplitude source drive) and the Signal channel (high amplitude source drive), then the sensor output for the currently invented Single Beam methodology will also be stable over time. For the methodology to work as exemplified in U.S. Pat. No. 8,143,581, both the Reference channel detector and the Signal channel detector must have narrow band pass filters with the same spectral characteristics, namely the same CWL and FWHM. Because of this, the ratio for the Signal channel detector output over the Reference channel detector output will not be affected by the spectral changes of the source due to aging over time. In the currently invented differential temperature source Single Beam methodology, this condition is automatically satisfied since both the Reference channel and the Signal channel share the same detector having the same filter but only being operated at different times.

The current invention uses a critical sensor component design feature for creating the needed absorption bias between the Reference channel (low amplitude drive cycle) and the Signal channel (high amplitude drive cycle) for the differential temperature source Single Beam sensor design approach in order to achieve the stable output performance characteristic for same. This novel design feature for the present invention has to do with the strategic design for the narrow band pass filter installed and located in front of the infrared detector. By designing the center wavelength (CWL) of this filter to overlap the most prominent portion of the absorption band of the gas of interest and the full width at half maximum (FWHM) of this filter narrow enough to cover the same prominent portion of the absorption band, the amount of radiation absorbed by the gas of interest as reflected in the signal output of the detector will be a strong function of the spectral output of the source. For the current Single Beam sensor design approach, since the spectral output of the source is different for the Reference channel from that for the Signal channel when the former is driven with a low voltage amplitude and the latter with a higher one, the signal output of the detector will be different for the Reference channel and for the Signal channel. Thus, the strategic design feature of the narrow band pass filter for the differential temperature source Single Beam sensor design approach can provide an adequate absorption bias as taught in U.S. Pat. No. 8,143,581 in order to render the output of such a Single Beam NDIR gas sensor significantly stable over time.

As it turns out, the differential temperature source Single Beam sensor design approach for an NDIR gas sensor as disclosed in the current invention not only satisfactorily addresses the issue of gas sensor output stability over time, it also leads to the design of a very compact NDIR gas sensor which can be produced at a very low unit cost. Furthermore, such a design approach can also adequately address the implementation of special features uniquely required by NDIR gas sensors to be used underground by miners in coal mines for warning of the impending danger of methane explosions and/or flooding.

FIG. 1 portrays a schematic drawing for the currently invented differential temperature source Single Beam sensor including both mechanical and electronic circuit layouts. As shown in FIG. 1, infrared source 1 and infrared detector 2 are mounted at opposite ends of an aluminum waveguide sample chamber block 3 which comprises basically an open conduit 4 connecting source 1 and detector 2. Outside air can flow freely into and out of sample chamber conduit 4 via four openings 5, each of which has a fine air filter attached to it (not shown in FIG. 1). The aluminum sample chamber block has four tapped screw holes 6 which are used to anchor an aluminum protective cover (not shown in FIG. 1) for the sensor. The functional role played by the aluminum protective cover will be described and explained later below. In addition to being soldered onto a printed circuit board (not shown in FIG. 1) which is located below but supports the aluminum sample chamber block 3, both the source 1 and the detector 2 are filled and secured with a silicon sealant 7 as an additional means to insure that the currently invented sensor is intrinsically safe as far as mechanical layout is concerned.

Printed circuit board 8 as depicted in FIG. 1 contains all the electronic circuit components of the currently invented sensor. Infrared source 1 is connected to a voltage driver circuit 9 which in turn is connected to Central Process Unit (CPU) 10. Infrared detector 2 is connected to the signal processing circuit unit 11 which is also connected to CPU 10. Printed circuit board 8 also houses a power regulator circuit 12 and an Indicator Unit 13 which contains the Alarm Buzzer, Ready Light and Warning Light for completing the entire electronic circuit layout for the currently invented sensor.

As discussed above, the currently invented single Beam NDIR gas sensor represents the simplest possible design of its class. Not only is the output stability of the sensor over time excellent, its high volume (>1 million units) unit production cost of a few US dollars can also be achieved and its overall dimensions of 2.50"×0.5"×0.5" are definitely attainable. Thus, the currently invented Single Beam Sensor is capable of overcoming all three of the afore-mentioned main reasons that prevent NDIR gas sensors from enjoying widespread high volume usages, namely sensor output stability over time, sensor dimensions and sensor high volume unit production cost.

It is especially satisfying to note that the currently invented Single Beam NDIR gas sensor is extremely well-suited for use in the application of producing NDIR methane and dew point gas sensors for use underground in mines for eliminating the danger of future methane explosions and/or flooding. First of all it is well-known that the NDIR gas measurement technique is applicable to the detection of any gas as long as the gas of interest has a strong absorption band in the infrared such that an appropriate narrow band pass filter can be designed to take advantage of it. Thus, in order to use the currently invented Single Beam NDIR gas sensing technique for the detection of methane and water vapor, one needs to provide the appropriate filter installed in front of the infrared detector. For the detection of methane, the filter should have a Central Wavelength (CWL) at ~3.38μ and a Full Width at Half Maximum (FWHM) pass band of ~0.19μ. For the detection of water vapor, the filter should a CWL=~2.57μ and a FWHM=~0.16μ.

In addition to provide the right filters for the currently invented Single Beam NDIR gas sensor, a few modifications have to be made in order to 1) meet all the safety requirements required of gas sensors operating underground in mines and 2) to take full advantage of the circumstances peculiar to gas detection for miners working underground. In order to comply with safety requirements in mines, an important feature for the currently invented Single Beam NDIR gas sensor is that it must be intrinsically safe. As illustrated in FIG. 1, the present design has taken this feature into full consideration by filling the space behind the source 1 and detector 2 (see FIG. 1) with silicone sealant 7. This feature, along with the fact that the sample chamber 3 is itself a block of solid aluminum with just a conduit machined out of it connecting the source 1 and the detector 2 as the sample chamber (see FIG. 1), will render the sensor intrinsically safe from a mechanical view point. Since all the electronic circuits for the sensor are operated below 3.0 VDC, the sensor is also designed to be intrinsically safe from the electrical standpoint.

Figure 2:
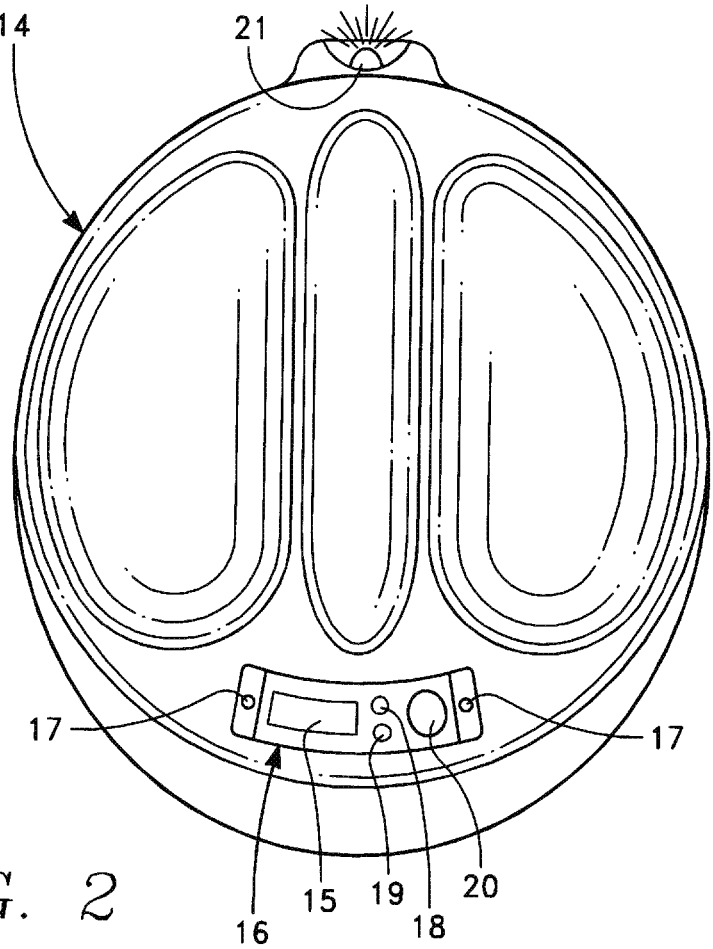
FIG. 2 illustrates the mounting of a single Beam NDIR gas sensor according to the present invention onto the back of a miner's helmet.

It is important to note that the currently invented NDIR Single beam gas sensor is specifically designed principally to prevent deadly mine explosions and/or flooding in underground coal mines by warning miners through detection of dangerous rate of concentration level increases for methane and/or water vapor. For this particular application, there are several unique operating circumstances for the design of this sensor that one can take advantage of. First of all, in order to perform this function of warning miners of potential methane explosions and/or flooding underground, each and every miner working underground should have a personal sensor close by and any alarm triggered by the gas sensor should be readily detectable by both the miner using it and miners located nearby. While the sensor might be worn on a waist belt, the best place to install this sensor is at the back of the miner's helmet 14 as shown in FIG. 2. As shown in FIG. 2, a currently invented Single Beam NDIR methane sensor (or a water vapor sensor) 15 is housed in a metallic (e.g., aluminum) protective cover 16 and is fittingly bolted by two screws 17 onto the back of the miner's helmet 14. A green LED "Ready" light 18 located on the Printed Circuit Board (PCB) 8 (see FIG. 1) of the sensor flashes green when the sensor is powered up and operating normally and ready to perform its warning functions. A red "Alarm" light 19 also located on PCB 8 (see FIG. 1) of the sensor flashes red when the gas detection alarm limit is reached or exceeded. At the same time a loud alarm (>90 db) sound will also be generated by alarm buzzer 20 which is also located on PCB 8 of the sensor. Also shown in FIG. 2 is a bright white LED light 21 mounted on the front of the miner's helmet 14. This bright white LED light 21 is powered by a rechargeable battery pack located inside helmet 14 (not shown in FIG. 2). The currently invented methane (or water vapor) sensor is also powered by the same rechargeable battery pack (wiring not shown in FIG. 2).

A methane or water vapor sensor according to the present invention can be retrofitted to existing miner's helmets or incorporated in the design of newly constructed helmets. When an existing helmet is to be retrofit, it is convenient to attach a base plate conforming to the helmet to the outsider surface of the helmet and secure an outer housing to the base plate. The base plate can be secured to the helmet by multiple fasteners through holes drilled into the helmet while the outer housing can be secured by the same multiple fasteners. It is especially preferred that the base plate and outer housing be metallic, preferably aluminum. The outer housing should have multiple apertures, covered by one or more filters, that allow gas to pass inside of the outer housing, while still serving to keep coal dust from coming into contact with the sensor mounted inside of the outer housing. It is especially preferred that any such filter be easily removable so that it can be replaced if it becomes clogged, but it should not block light from leaving the apertures so that light emitted from LEDs mounted inside of the outer housing is visible through the apertures, and such visibility is enhanced by ensuring that the inside of the outer housing is specularly reflective. For newly constructed helmets, the various parts already described can be incorporated into the helmet design without the need for retrofitting. For either retrofit helmets or for new helmets, it is especially preferred that the sensor is mounted on the outside of the miner's helmet rather than on its inside where gas circulation will be more limited.

By installing the currently invented methane (or water vapor) sensor conveniently at the back of the miner's helmet as described above, one takes advantage of several aspects of such an application. First and foremost is the fact that a miner working underground in a coal mine will always wear a helmet with a bright LED light mounted in front of it. From the sensor's warning function standpoint, the location of this sensor at the back of the miner's helmet is just about optimum. This sensor will always follow the miner wherever the miner works and that is one of the most important functions of the sensor. Second, the sensor can readily derive power from the same rechargeable battery pack of the helmet and because of the fact that the miner's light has to be functioning properly whenever the miner is working underground, the sensor will always have an adequate power supply. Third, because the sensor is omnipresent with the miner's helmet, the green LED flashing light of the sensor will always remind the miner that the methane sensor is working properly before the miner goes underground to work in the mines. Finally, the fact that the alarm red LED light will be flashing at the back of a working miner's helmet allows the alarm buzzer sound heard by the miner to be effectively shared with other miners working behind the miner in the same area. This provides a double alarm warning for preventing potential methane explosion or flooding underground in coal mines.

While locating the currently invented sensor at the back of a miner's helmet is optimal, for the reasons already noted, the present invention is not limited to such an arrangement, since benefits can also be achieved from less optimal arrangements that can still be personal to every miner. For example, a housing can be designed that can be worn on a miner's belt or other article of clothing, or even worn as an arm band or attached by some other means or mechanism so that it is always with a miner, as long as the device is readily mobile, convenient, and not likely to be left behind or deactivated due to a depleted power source. However, any such arrangement suffers from potential drawbacks concerning ease of use and adequacy of triggering an alarm condition. If the personal alarm unit is not located on a miner's helmet, an audible alarm may need to louder and/or combined with a vibrational alarm, or other alarm mechanism, so that the alarm condition can be readily detected by the miner using it. Also, such an alarm may not be as readily detectable by nearby miners without inclusion of one or more additional alarm mechanisms. For example, a personal alarm device worn by a miner on a belt might also trigger a separate visual alarm located on a miner's helmet, or one or more visual alarms worn somewhere else by the miner. Accordingly, for any personal alarm device that is not located on a miner's helmet, it is important that it be designed so that its alarm condition is not only easily detectable by the miner using it, but also by other miners located in close proximity to the miner using it. The currently invented NDIR Single Beam methane sensor is designed with two gas detection criteria for sounding the alarm. The first criterion is based upon the detection of an abnormally high rate of increase of methane concentration level in the work area of the miners. Since the lower explosion limit (LEL) of methane in typical air above ground is ~4.60% or ~46,000 ppm of methane and the typical methane concentration level underground in coal mines is ~500 ppm or less, a monotonic rate of increase of 1,000 ppm/min for a period of 10 minutes which gives the miners a time period of at least ~30 minutes to evacuate the working area before the LEL is reached would be adequate for the first alarm criterion. The second criterion is based upon the actually detected level of methane concentration at any time in the work area. This level for alarm is set to be ~10,000 ppm of methane. This level of detected methane level alarm is sufficiently below the LEL limit of explosion for methane (~46,000 ppm) that would allow adequate time for the workers to evacuate the work area and report the dangerous situation to proper authorities.

For the currently invented water vapor sensor, only one detection criterion is designed into it for sounding the alarm since there is no LEL for water vapor. Only the unexpected and sudden appearance of a large amount of water in the work site is relevant in this case. Even the absolute level of water vapor pressure detected in the work area cannot be used as an alarm criterion because this value is a variable that could change over time. However, if the alarm criterion is based upon the detection of an abnormally high rate of water vapor increase over a short period of time, then it is probable that a large amount of water has suddenly appeared in the work area and that could be the early sign of a worker excavating into an underground water reservoir. The high rate of 30 mmHg/min monotonic increase of water vapor pressure over a period of 10 minutes is set as the alarm criterion for the presently invented water vapor sensor.

An important performance feature of the currently invented methane (or water vapor) sensor for mines is its output stability over time. While trusting the fact that the sensor will stay accurate over time is one thing, verifying it to be indeed the case is quite another matter. Needless to say, if one has to periodically check the accuracy of the currently invented methane (or water vapor) sensor, the service maintenance expense would be intolerably high since there are so many miners that would be equipped with this sensor. Fortunately, all miners after a certain shift of duty underground must surface above ground until their next shift. Therefore, at least for the currently invented methane sensor, this affords an excellent opportunity for the sensor to independently recalibrate itself after every miner's shift of work underground since the concentration of methane above ground is typically less than ~50 ppm. Thus, if the methane sensor is recalibrated whenever the sample concentration of methane falls below an ambient threshold level of methane (which might be set, e.g., at 100 ppm), the accuracy of the methane sensor is effectively guaranteed to be +/−50 ppm which is adequate to effectively guarantee the alarm criterions set for the sensor underground in a mine.

While the invention has been described herein with reference to certain embodiments, those embodiments have been presented by way of example only, and not to limit the scope of the invention. Accordingly, at a minimum, the following embodiments fall within the scope of the present invention.

Embodiment 1

An apparatus, comprising:

a miner's helmet with a light mounted at a front side of the miner's helmet;

a power source mounted to the miner's helmet that is electrically connected to the light;

a gas sensor mounted to the miner's helmet that is electrically connected to the power source;

a visual indicator mounted to a rear side of the miner's helmet; and electronics for changing the visual indicator in response to output from the gas sensor;

wherein the gas sensor measures a concentration of a gas of interest and causes the visual indicator to display an alarm when the concentration of the gas of interest detected by the gas sensor triggers an alarm condition of the electronics.

Embodiment 2

The apparatus of embodiment 1, wherein the visual indicator provides a first visual indication when the gas sensor is on and a second visual indication when the alarm condition is triggered.

Embodiment 3

The apparatus of embodiment 1 or 2, further comprising an audible alarm device mounted to the miner's helmet that sounds an audible alarm when the alarm condition is triggered.

Embodiment 4

The apparatus of any of embodiments 1-3, wherein the gas sensor is a non-dispersive infrared ("NDIR") gas sensor.

Embodiment 5

The apparatus of embodiment 4, wherein the NDIR gas sensor is comprised of:

a single infrared source for generating infrared radiation into a sample chamber that is alternatively pulsed between a high temperature and a low temperature;

a detector located in the sample chamber;

a narrow band pass filter with a spectral characteristic that substantially overlaps a strong absorption band for the gas of interest located between the single infrared source and the detector; and electronics for determining a sample concentration of the gas of interest by use of an absorption bias between a signal output of the detector at the high temperature and a reference output of the detector at the low temperature;

wherein a convoluted output of the single infrared source and the narrow band pass filter is substantially coincident with the strong absorption band at the high temperature.

Embodiment 6

The apparatus of any of embodiments 1-5, wherein the gas of interest is methane and the alarm condition is triggered by either an abnormally high rate of increase of methane concentration level or by an elevated concentration of methane that is above approximately 500 ppm and substantially below a lower explosion limit of methane.

Embodiment 7

The apparatus of embodiment 6, wherein the abnormally high rate of increase of methane concentration level is a monotonic rate of increase of approximately 1,000 ppm/min. for a predetermined period of time and the elevated concentration of methane is approximately 10,000 ppm.

Embodiment 8

The apparatus of any of embodiments 1-5, wherein the gas of interest is methane and the alarm condition is triggered by an abnormally high rate of increase of methane concentration level.

Embodiment 9

The apparatus of any of embodiments 1-5, wherein the gas of interest is methane and the alarm condition is triggered by an elevated concentration of methane that is above approximately 500 ppm and substantially below a lower explosion limit of methane.

Embodiment 10

The apparatus of any of embodiments 6-9, wherein the gas sensor is recalibrated whenever the sample concentration of methane falls below an ambient threshold level of methane.

Embodiment 11

The apparatus of any of embodiments 1-5, wherein the gas of interest is water vapor and the alarm condition is triggered by an abnormally high rate of increase of water vapor over a short period of time.

Embodiment 12

The apparatus of embodiment 11, wherein the alarm condition is triggered by a rate of 30 mmHg/min monotonic increase of water vapor pressure over a period of 10 minutes.

Embodiment 13

The apparatus of any of embodiments 1-12, wherein the gas sensor is mounted within a metallic housing mounted to an outside surface of the rear side of the miner's helmet.

Embodiment 14

The apparatus of embodiment 13, wherein the housing has a plurality of housing apertures, each of which is covered with a filter, and the sample chamber has a plurality of sample chamber apertures, each of which is covered with a fine filter.

Embodiment 15

The apparatus of embodiment 5, 13 or 14, wherein the electronics will trigger a failsafe alarm condition when the signal output of the detector falls below an obscuration level.

Embodiment 16

The apparatus of any of embodiments 1-15, wherein the electronics are operated below 3.0 VDC.

Embodiment 17

An apparatus, comprising:

a housing;

a power source mounted in the housing;

a gas sensor mounted to the housing that is electrically connected to the power source;

an alarm indicator; and electronics for creating an alarm by the alarm indicator in response to output from the gas sensor;

wherein the gas sensor measures a concentration of a gas of interest and causes the alarm indicator to generate an alarm when the concentration of the gas of interest detected by the gas sensor triggers an alarm condition of the electronics; and wherein the gas of interest is methane and the alarm condition is triggered by either an abnormally high rate of increase of methane concentration level or by an elevated concentration of methane that is above approximately 500 ppm and substantially below a lower explosion limit of methane.

Embodiment 18

The apparatus of embodiment 17, wherein the alarm indicator provides a first indication when the gas sensor is on and a second indication when the alarm condition is triggered.

Embodiment 19

The apparatus of embodiment 17 or 18, further comprising an audible alarm device mounted to the helmet that sounds an audible alarm when the alarm condition is triggered.

Embodiment 20

The apparatus of any of embodiments 17-19, wherein the gas sensor is a non-dispersive infrared ("NDIR") gas sensor.

Embodiment 21

The apparatus of embodiment 20, wherein the NDIR gas sensor is comprised of:

a single infrared source for generating infrared radiation into a sample chamber that is alternatively pulsed between a high temperature and a low temperature;

a detector located in the sample chamber;

a narrow band pass filter with a spectral characteristic that substantially overlaps a strong absorption band for the gas of interest located between the single infrared source and the detector; and electronics for determining a sample concentration of the gas of interest by use of an absorption bias between a signal output of the detector at the high temperature and a reference output of the detector at the low temperature;

wherein a convoluted output of the single infrared source and the narrow band pass filter is substantially coincident with the strong absorption band at the high temperature.

Embodiment 22

The apparatus of any of embodiments 17-21, wherein the gas sensor is recalibrated whenever the sample concentration of methane falls below an ambient threshold level of methane.

Embodiment 23

The apparatus of embodiment 22, wherein the abnormally high rate of increase of methane concentration level is a monotonic rate of increase of approximately 1,000 ppm/min, for a predetermined period of time and the elevated concentration of methane is approximately 10,000 ppm.

Embodiment 24

An apparatus, comprising:

a housing;

a power source mounted in the housing;

a gas sensor mounted to the housing that is electrically connected to the power source;

an alarm indicator; and electronics for creating an alarm by the alarm indicator in response to output from the gas sensor;

wherein the gas sensor measures a concentration of a gas of interest and causes the alarm indicator to generate an alarm when the concentration of the gas of interest detected by the gas sensor triggers an alarm condition of the electronics; and wherein the gas of interest is water vapor and the alarm condition is triggered by an abnormally high rate of increase of water vapor over a short period of time.

Embodiment 25

The apparatus of embodiment 24, wherein the alarm condition is triggered by a rate of 30 mmHg/min monotonic increase of water vapor pressure over a period of 10 minutes.

Embodiment 26

The apparatus of any of embodiments 17-25, wherein the gas sensor is mounted within a metallic housing.

Embodiment 27

The apparatus of embodiment 26, wherein the metallic housing has a plurality of housing apertures, each of which is covered with a filter, and the sample chamber has a plurality of sample chamber apertures, each of which is covered with a fine filter.

Embodiment 28

The apparatus of embodiment 19, 26 or 27, wherein the electronics will trigger a failsafe alarm condition when the signal output of the detector falls below an obscuration level.

Embodiment 29

The apparatus of any of embodiments 17-28, wherein the electronics are operated below 3.0 VDC.

Additional embodiments will be obvious to those skilled in the art having the benefit of this detailed description. Further modifications are also possible in alternative embodiments without departing from the inventive concept as defined by the following claims.

What is claimed is:

1. An apparatus, comprising:

a miner's helmet with a light mounted at a front side of the miner's helmet;

a power source mounted to the miner's helmet that is electrically connected to the light;

a gas sensor mounted to the miner's helmet that is electrically connected to the power source;

a visual indicator mounted to a rear side of the miner's helmet; and electronics for changing the visual indicator in response to output from the gas sensor;

wherein the gas sensor measures a concentration of a gas of interest and causes the visual indicator to display an alarm when the concentration of the gas of interest detected by the gas sensor triggers an alarm condition of the electronics;

wherein the gas sensor is a non-dispersive infrared ("NDIR") gas sensor comprised of:

a single infrared source for generating infrared radiation into a sample chamber that is alternatively pulsed between a high temperature and a low temperature;

a detector located in the sample chamber;

a narrow band pass filter with a spectral characteristic that substantially overlaps a strong absorption band for the gas of interest located between the single infrared source and the detector; and electronics for determining a sample concentration of the gas of interest by use of an absorption bias between a signal output of the detector at the high temperature and a reference output of the detector at the low temperature;

wherein a convoluted output of the single infrared source and the narrow band pass filter is substantially coincident with the strong absorption band at the high temperature.

2. The apparatus of claim 1, wherein the visual indicator provides a first visual indication when the gas sensor is on and a second visual indication when the alarm condition is triggered.

3. The apparatus of claim 2, further comprising an audible alarm device mounted to the miner's helmet that sounds an audible alarm when the alarm condition is triggered.

4. The apparatus of claim 1, wherein the gas of interest is methane and the alarm condition is triggered by either an abnormally high rate of increase of methane concentration level or by an elevated concentration of methane that is above approximately 500 ppm and substantially below a lower explosion limit of methane.

5. The apparatus of claim 4, wherein the abnormally high rate of increase of methane concentration level is a monotonic rate of increase of approximately 1,000 ppm/min. for a predetermined period of time and the elevated concentration of methane is approximately 10,000 ppm.

6. The apparatus of claim 1, wherein the gas of interest is methane and the alarm condition is triggered by an abnormally high rate of increase of methane concentration level.

7. The apparatus of claim 1, wherein the gas of interest is methane and the alarm condition is triggered by an elevated concentration of methane that is above approximately 500 ppm and substantially below a lower explosion limit of methane.

8. The apparatus of 4, wherein the gas sensor is recalibrated whenever the sample concentration of methane falls below an ambient threshold level of methane.

9. An apparatus, comprising:

a housing;

a power source mounted in the housing;

a gas sensor mounted to the housing that is electrically connected to the power source;

an alarm indicator; and electronics for creating an alarm by the alarm indicator in response to output from the gas sensor;

wherein the gas sensor measures a concentration of a gas of interest and causes the alarm indicator to generate an alarm when the concentration of the gas of interest detected by the gas sensor triggers an alarm condition of the electronics; and wherein the gas of interest is methane and the alarm condition is triggered by either an abnormally high rate of increase of methane concentration level or by an elevated concentration of methane that is above approximately 500 ppm and substantially below a lower explosion limit of methane;

wherein the gas sensor is a non-dispersive infrared ("NDIR") gas sensor is comprised of:

a single infrared source for generating infrared radiation into a sample chamber that is alternatively pulsed between a high temperature and a low temperature;

a detector located in the sample chamber;

a narrow band pass filter with a spectral characteristic that substantially overlaps a strong absorption band for the gas of interest located between the single infrared source and the detector; and electronics for determining a sample concentration of the gas of interest by use of an absorption bias between a signal output of the detector at the high temperature and a reference output of the detector at the low temperature;

wherein a convoluted output of the single infrared source and the narrow band pass filter is substantially coincident with the strong absorption band at the high temperature.

10. The apparatus of any of claims 9, wherein the gas sensor is recalibrated whenever the sample concentration of methane falls below an ambient threshold level of methane.

11. The apparatus of claim 10, wherein the abnormally high rate of increase of methane concentration level is a monotonic rate of increase of approximately 1,000 ppm/min. for a predetermined period of time and the elevated concentration of methane is approximately 10,000 ppm.

* * * * *